US006856293B2

(12) United States Patent
Bordi

(10) Patent No.: US 6,856,293 B2
(45) Date of Patent: Feb. 15, 2005

(54) ADJUSTABLE ANTENNA

(75) Inventor: Mika Bordi, Espoo (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 10/471,189

(22) PCT Filed: Mar. 13, 2002

(86) PCT No.: PCT/FI02/00201

§ 371 (c)(1),
(2), (4) Date: Sep. 8, 2003

(87) PCT Pub. No.: WO02/075845

PCT Pub. Date: Sep. 26, 2002

(65) Prior Publication Data

US 2004/0233108 A1 Nov. 25, 2004

(30) Foreign Application Priority Data

Mar. 15, 2001 (FI) ..... 20010519

(51) Int. Cl.[7] ..... H01Q 1/24
(52) U.S. Cl. ..... 343/702; 343/787
(58) Field of Search ..... 343/700 MS, 702, 343/787, 829, 846

(56) References Cited

U.S. PATENT DOCUMENTS 3,811,128 A * 5/1974 Munson ..... 343/787
4,751,513 A 6/1988 Daryoush et al.
5,327,148 A * 7/1994 How et al. ..... 343/700 MS
5,589,842 A 12/1996 Wang et al.
5,982,335 A * 11/1999 Faraone et al. ..... 343/787
6,292,143 B1 9/2001 Romanofsky
6,791,496 B1 * 9/2004 Killen et al. ..... 343/700 MS

FOREIGN PATENT DOCUMENTS

EP 0 884 707 A1 12/1998
EP 0 899 702 A2 3/1999

OTHER PUBLICATIONS

P.J. Rainville and F.J. Harackiewicz, "Magnetic Tuning of a Microtrip Patch Antenna Fabricated on a Ferrite Film", IEEE Microwave and Guided Wave Letters, vol. 2, No. 12, Dec. 1992. pp. 483–485.

* cited by examiner

*Primary Examiner*—Tho Phan
(74) *Attorney, Agent, or Firm*—Darby & Darby

(57) ABSTRACT

Antenna structure (200) which finds particular utility in mobile stations and the electrical characteristics of which can be electrically modified. The radiating element (210) of the antenna or a part thereof is manufactured from a strongly magnetostrictive material. The antenna is equipped with at least one electromagnet (220) by means of which a magnetic field (ψ) can be generated into the magnetostrictive material. This causes the radiating element to grow (Δl) in a certain direction, whereby the resonance frequency of the antenna will decrease. The antenna can be electrically adjusted without adding any component in the antenna itself, thereby making the adjustment reliable.

8 Claims, 3 Drawing Sheets

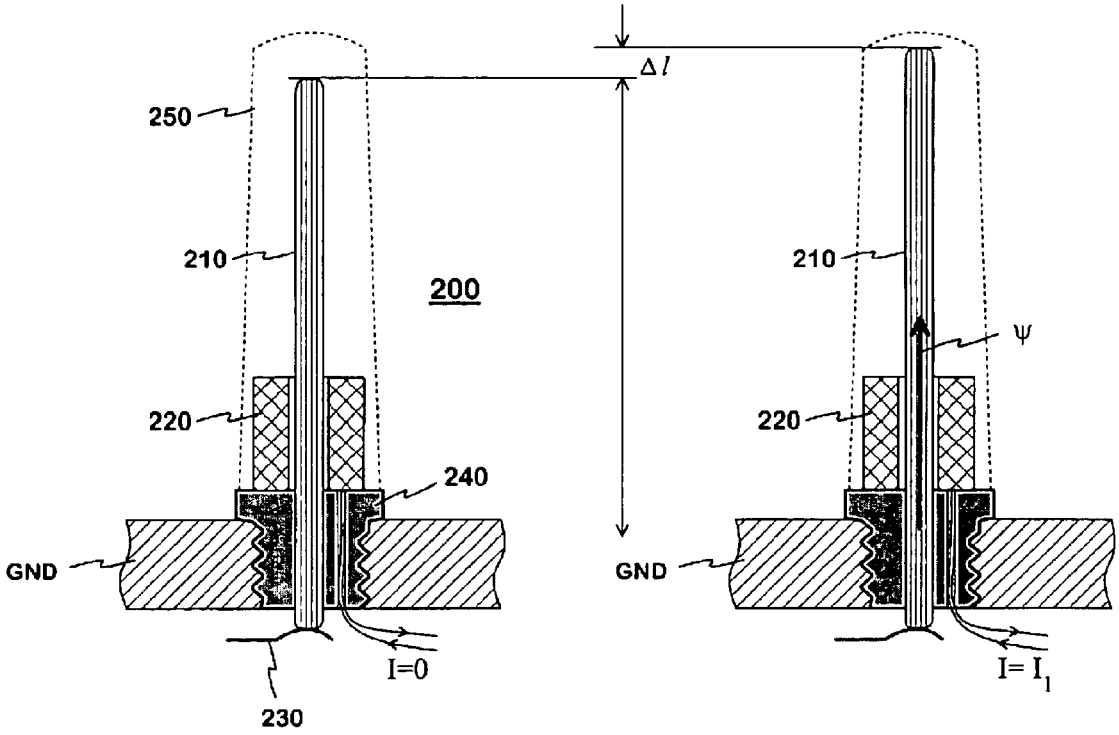
Fig. 2a
Fig. 2b
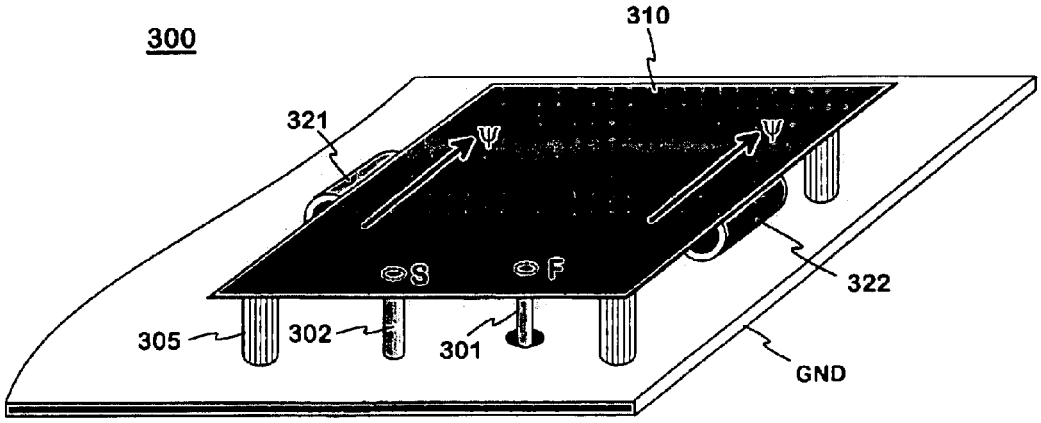
Fig. 3

ADJUSTABLE ANTENNA

The invention relates to an antenna structure which finds particular utility in mobile stations and the electrical characteristics of which can be electrically modified.

BACKGROUND OF THE INVENTION

Modifiability of antenna structure is a preferable characteristic in communications devices designed to be used in more than one radio system. Such systems include e.g. the AMPS (Advanced Mobile Phone System), GSM900 (Global System for Mobile Telecommunications), DCS (Digital Cellular System), GSM1800, GSM1900, WCDMA (Wideband Code Division Multiple Access) and UMTS (Universal Mobile Telecommunication System). An antenna may be construed so as to have two separate operating bands which cover the frequency ranges used by the different systems, or so as to have a single, relatively wide, operating band which covers the frequency ranges of at least two systems. In the latter case there is, however, the risk that the antenna characteristics are not satisfactory e.g. in part of the wide operating band. This drawback is avoided if the resonance frequency of the antenna can be electrically shifted so that the operating band falls into the frequency range of the currently used system.

From the prior art it is known an electrical adjustment method for an antenna, where the reactance generated by capacitors or coils connected to a monopole antenna, for example, can be changed by means of electronic switches. As the reactance changes, so do the electrical length and resonance frequency of the antenna. A drawback of this method is that the arrangement calls for extra components.

From the publication JP 8242118 it is known a solution according to FIG. 1. It comprises a planar radiating element 110 with two openings, such as openings 111 and 112, at each side of the element, extending from the edge of the element towards the center area thereof. To each opening an electronic switch is connected which, when conducting, shorts the opening in question at a certain point. For example, switch SW1 can be used to short-circuit opening 111 relatively near the mouth of the opening, and switch SW2 can be used to short-circuit opening 112 approximately at the middle of the opening. Changing the state of a switch changes the electrical dimensions of the radiating element and, thereby, its resonance frequency. Each switch is controlled with a control signal of its own, such as C1 for switch SW1, so the antenna can be adjusted at relatively small steps. The disadvantage of this solution is the extra cost caused by the quantity of switch components and their mounting.

SUMMARY OF THE INVENTION

The object of the invention is to realize the electrical adjustment of an antenna in a novel means which alleviates said disadvantages of the prior art.

An antenna structure according to the invention is characterized by that which is specified in the independent claim 1. Some preferred embodiments of the invention are presented in the other claims.

The basic idea of the invention is as follows: The radiating element of an antenna or a part thereof is manufactured from a strongly magnetostrictive material. The antenna is equipped with at least one electromagnet by means of which a magnetic field can be generated into the magnetostrictive material. This will cause the radiating element to grow in a certain dimension, thus reducing the resonance frequency of the antenna. The adjustment of the resonance frequency can be realized either as two-step or continuous.

An advantage of the invention is that an antenna according to it can be adjusted electrically without adding any component in the antenna itself. This brings the additional advantage that the adjustment is reliable since there cannot occur component or switching faults in the operation of the apparatus. Another advantage of the invention is that the manufacturing costs of an antenna according to the invention are smaller than those of prior-art adjustable antennas.

BRIEF DESCRIPTION OF THE DRAWINGS

The invention is below described more closely. Reference will be made to the accompanying drawings where FIG. 3 shows a second example of an adjustable antenna structure according to the invention.

DETAILED DESCRIPTION OF THE INVENTION

Figure 1:
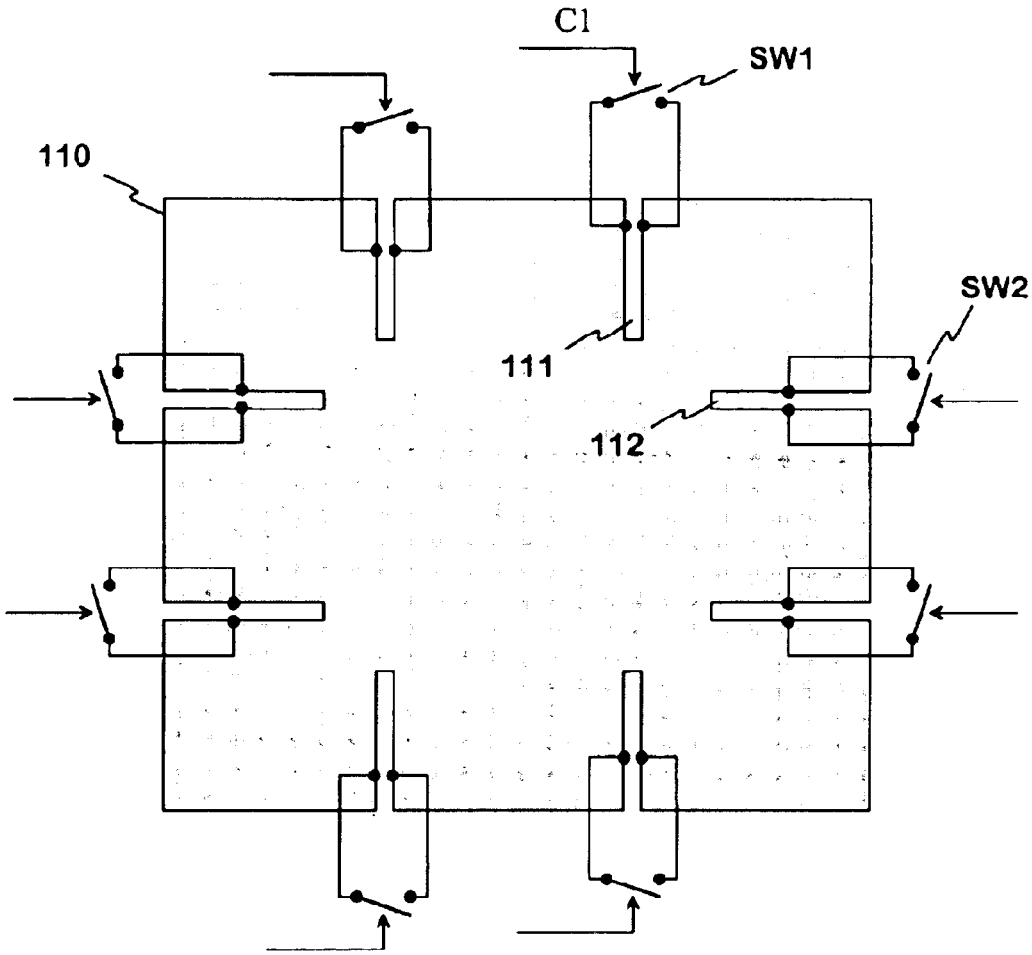
Fig. 1 PRIOR ART
FIG. 1 shows an example of a prior-art adjustable antenna structure, FIGS. 2*a,b* show an example of an adjustable antenna structure according to the invention.

In FIGS. 2*a* and *b*, the invention is applied to a monopole antenna. The antenna structure 200, shown in longitudinal section, comprises a radiating monopole element 210 the length of which corresponds to a quarter of the wavelength at the operating frequency, and a winding 220 which constitutes an electromagnet. Functionally, the antenna structure comprises the frame GND of the radio apparatus in question, serving as a ground plane, to which the radiating element 210 is fastened through an insulating element 240. The radiating element is connected at its lower end to the antenna port of the radio apparatus through a feed conductor 230. The structure is protected by a hood 250, drawn in broken line.

In the example depicted by FIGS. 2*a,b,* the cylindrical winding 220 is round the lower part of the monopole element 210. In FIG. 2*a,* the current I through the winding 220 is zero and, therefore, there is no magnetic field generated by the winding. The monopole element has a certain electrical length l. In FIG. 2*b,* a certain direct current $I_1$ is led into the winding 220. The direct current causes in the winding 220 a magnetic flux $\psi$ the majority of which travels through the monopole element in its longitudinal direction and then goes around the winding by the outside, forming a closed path.

The monopole element 210 is advantageously made from a magnetically controlled shape memory (MSM) material. It is divided in the longitudinal direction of the monopole into elementary layers so that in every second elementary layer the internal magnetic moments are arranged substantially in the longitudinal direction of the monopole, i.e. along the axis of the monopole. In every other elementary layer, on the other hand, the magnetic moments are also arranged parallely, but forming a significant angle relative to the longitudinal direction of the monopole element. If the magnetic field strength corresponding to the external magnetic flux $\psi$ is sufficient, it will turn the crystal structures of the latter elementary layers such that the magnetic moments throughout the whole element will be parallel to the direction of the axis of the monopole element. This means that the length of the monopole element will increase as the internal zigzag structure of the material will "straighten out". This change may also be arranged so as to be gradual by increasing the external magnetic field strength gradually. When the external magnetic field is removed, the material will return to the initial state and the monopole element will thus retain its original length.

In FIG. 2*b,* the magnetic field of the winding 220 has resulted in an increase Δl in the electrical length 1 of the monopole element. The relative increase Δl/l may be e.g. 5%. If the antenna is specified in the rest position to function e.g. in the WCDMA system, a good 5-per-cent adjustment range is enough to shift the operating band into the GSM1900 or GSM1800 system band. Similarly it is possible to shift from the GSM900-band to the AMPS-band.

In FIG. 3 the invention is applied to a planar antenna. The antenna structure 300 comprises a planar radiating element 310 and a ground plane GND parallel thereto. The feed conductor 301 of the antenna is connected to a point F in the radiating element. The radiating element is also connected at a point S to the ground plane via a short-circuit conductor 302, whereby the antenna is a planar inverted F antenna (PIFA). The radiating element is supported to the ground plane through insulating elements such as element 305. In this example the structure further comprises two electromagnets 321 and 322 formed by cylindrical coils. These are located at a close distance from the radiating plane, below it and at opposing sides. A "close distance" means here and in the claims a distance which is shorter than the distance between the radiating plane and ground plane. When a direct current is led into the said windings, part of the magnetic flux ψ of the both windings travels substantially parallely through the radiating plane 310. In this case, too, the radiating plane is made from an MSM material and in such a manner that the transformation caused by the magnetic field occurs in the longitudinal direction of the electromagnets 321 and 322. Thus, by means of the control current of the electromagnets, the dimension of the radiating planar element in one direction and, thereby, the resonance frequency of the element can be changed. The quantity of the electromagnets may naturally vary; there may be more than two of them, too.

Figure 4:
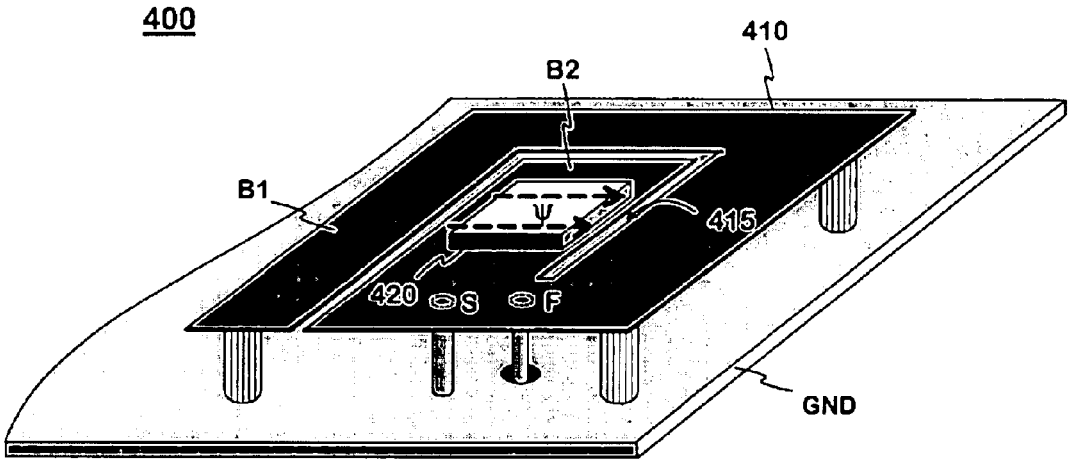
FIG. 4 shows a third example of an adjustable antenna structure according to the invention.

In FIG. 4 the invention is applied to a dual-band planar antenna. The basic antenna structure 400 is similar to that shown in FIG. 3 except that now the radiating planar element 410 has a slit 415 the shape of which resembles a rectangular J starting from the edge of the planar element in such a manner that the plane is divided into two branches viewed from the antenna feed point F. The first branch B1 follows the edges of the planar element and is clearly longer than the second branch B2 in the center area of the planar element. The antenna thus has got two bands. The electromagnet 420 is in this example a flat winding placed on the second branch B2. The winding is wound such that the magnetic flux ψ caused by the current in the winding travels inside the winding and in the planar element 410 transversely with respect to the longitudinal axis of the second branch. The direction of the change in the length of the planar element made from MSM material is the said transversal direction; thus it deviates by 90 degrees from the direction of the change in the length of the corresponding element in FIG. 3. As the second branch B2 grows in its transversal direction, the portions of the slit 415 at its both sides become narrower. Thereby, the electromagnetic coupling between the first and second branches becomes stronger. This further results in an increase in the electrical lengths of the branches and a decrease in their resonance frequencies.

The electromagnet 420 could also be placed on the slit 415. In this case, too, there could be several electromagnets. Moreover, they could be placed in the space between the planar element and ground plane.

Figure 5:
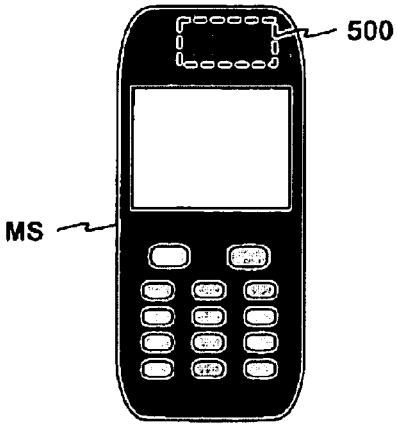
FIG. 5 shows an example of an apparatus equipped with an antenna according to the invention.

FIG. 5 shows a mobile station MS comprising an adjustable antenna structure 500 according to the invention.

Above it was described antenna structures according to the invention. Naturally the antenna structure may differ, even to a great extent, from those described. The inventional idea may be applied in different ways within the scope defined by the independent claim 1.

What is claimed is:

1. An antenna structure comprising at least one radiating element and means to electrically modify electrical characteristics of the antenna structure, the radiating element being at least partly made from a magnetostrictive material, and the means to electrically modify electrical characteristics of the antenna structure comprising at least one electromagnet arranged to generate a magnetic field into said magnetostrictive material in order to increase a dimension of the radiating element.

2. An antenna structure according to claim 1, the characteristic to be modified therein being a resonance frequency.

3. An antenna structure according to claim 1, the magnetostrictive material being an MSM material.

4. An antenna structure according to claim 1, the radiating element being a monopole element and the electromagnet being a winding around the monopole element.

5. An antenna structure according to claim 1, the radiating element being a planar element and the electromagnet being a winding at a close distance from the planar element.

6. An antenna structure according to claim 5, the planar element comprising at least two branches and the electromagnet being arranged to change an electromagnetic coupling between said branches.

7. An antenna structure according to claim 1, comprising at least two electromagnets.

8. A radio apparatus having an antenna, which comprises at least one radiating element and means to electrically modify electrical characteristics of the antenna, the radiating element being at least partly made from a magnetostrictive material and the means to electrically modify electrical characteristics of the antenna structure comprising at least one electromagnet arranged to generate a magnetic field into said magnetostrictive material in order to increase a dimension of the radiating element.

* * * * *